US006488427B1

(12) United States Patent
Breidenbach et al.

(10) Patent No.: US 6,488,427 B1
(45) Date of Patent: Dec. 3, 2002

(54) COSMETIC APPLICATOR

(76) Inventors: Diane C. Breidenbach, 53 S. Pond La., Smithtown, NY (US) 11787; Laurence W. Mille, 53 S. Pond La., Smithtown, NY (US) 11787

( * ) Notice: Subject to any disclaimer, the term of this patent is extended or adjusted under 35 U.S.C. 154(b) by 0 days.

(21) Appl. No.: 09/515,956

(22) Filed: Feb. 29, 2000

(51) Int. Cl.[7] ..... A45D 40/06
(52) U.S. Cl. ..... 401/75; 401/78; 401/82; 401/87; 401/175
(58) Field of Search ..... 401/65, 66, 75, 401/76, 78, 82, 87, 174, 175

(56) References Cited

U.S. PATENT DOCUMENTS

| | | | | |
|---|---|---|---|---|
| 2,464,278 | A | | 3/1949 | Wilson |
| D164,327 | S | | 8/1951 | Roehrich |
| 3,156,272 | A | | 11/1964 | Indrunas |
| 3,335,854 | A | | 8/1967 | Landen |
| 3,578,223 | A | | 5/1971 | Armour |
| 3,696,919 | A | | 10/1972 | Miles |
| 3,726,446 | A | | 4/1973 | Hays |
| 3,747,773 | A | | 7/1973 | Jackson |
| 3,825,021 | A | * | 7/1974 | Seidler ..... 401/75 X |
| 3,846,518 | A | | 11/1974 | McPhee |
| 3,856,138 | A | | 12/1974 | Maekawa |
| 3,897,004 | A | | 7/1975 | French |
| D241,120 | S | | 8/1976 | Dekker |
| 4,133,445 | A | | 1/1979 | Mandelbaum |
| 4,170,082 | A | | 10/1979 | Freedman |
| 4,174,035 | A | | 11/1979 | Wiegner |
| 4,196,808 | A | | 4/1980 | Pardo |
| 4,203,534 | A | | 5/1980 | Finke |
| D260,559 | S | | 9/1981 | Scalice |
| 4,300,681 | A | | 11/1981 | Klygis et al. |
| 4,340,157 | A | | 7/1982 | Darner |
| 4,377,234 | A | | 3/1983 | Kaplan |
| 4,530,439 | A | | 7/1985 | Finnell |
| 4,533,052 | A | | 8/1985 | Fruchey et al. |
| 4,533,068 | A | | 8/1985 | Meierhoefer |
| 4,542,930 | A | | 9/1985 | Adams |
| 4,562,685 | A | | 1/1986 | Tomita et al. |
| 4,614,267 | A | | 9/1986 | Larkin |
| 4,643,426 | A | | 2/1987 | Adams |
| 4,667,839 | A | | 5/1987 | Crisci |
| 4,690,276 | A | | 9/1987 | Sussman |
| 4,690,673 | A | | 9/1987 | Bloomquist |
| D294,804 | S | | 3/1988 | Lunderman et al. |
| 4,782,670 | A | | 11/1988 | Long et al. |
| 4,801,052 | A | * | 1/1989 | Citterio ..... 401/76 X |
| 4,840,908 | A | | 6/1989 | Burns |
| 4,872,774 | A | | 10/1989 | Rosso |
| 4,993,860 | A | | 2/1991 | Sommer |
| D322,391 | S | | 12/1991 | Morane |
| D325,342 | S | | 4/1992 | Balavich |
| 5,104,008 | A | | 4/1992 | Crisci |

(List continued on next page.)

OTHER PUBLICATIONS

Carolina Herrera—New York, "212 A New Area in Fragrance".

*Primary Examiner*—Gregory Huson
*Assistant Examiner*—Kathleen J. Prunner
(74) *Attorney, Agent, or Firm*—Thomas A. O'Rourke; Wyatt Gerber & O'Rourke

(57) ABSTRACT

An applicator for dispensing a product comprises an exterior top surface, an exterior sidewall, and a base. The applicator has a chamber which constitutes a reservoir for holding the product to be dispensed. The reservoir has top wall, a bottom wall and a side wall. The applicator has an orifice for dispensing product, and the orifice connects the top surface to the top wall. The chamber has a disk capable of traveling through the chamber forcing product through the orifice as it travels through the chamber. The disk has a product contact surface that contacts a major portion of the top surface when the travel of the disk is complete so that product remaining in the chamber is minimized.

8 Claims, 9 Drawing Sheets

U.S. PATENT DOCUMENTS 5,110,014 A 5/1992 Doundoulakis
5,141,136 A 8/1992 Tignor
5,158,191 A 10/1992 Douglas et al.
5,174,460 A 12/1992 Minnette
5,273,083 A 12/1993 Burrows
D344,017 S 2/1994 Lang et al.
D345,915 S 4/1994 Fareri et al.
5,310,094 A 5/1994 Martinez et al.
5,314,067 A 5/1994 Strock
5,316,159 A 5/1994 Douglas et al.
5,338,123 A 8/1994 Obersteller et al.
5,341,691 A 8/1994 Callis et al.
5,373,972 A 12/1994 Boystrom et al.
5,413,152 A 5/1995 Burrows
5,456,294 A 10/1995 Tsao et al.
5,464,110 A 11/1995 Heyworth
5,469,980 A 11/1995 O'Meara et al.
D368,427 S 4/1996 Bicknell et al.
5,505,325 A 4/1996 Thompson et al.
D370,088 S 5/1996 Burns
5,525,299 A 6/1996 Lowe
5,526,960 A 6/1996 Breidenbach et al.
5,531,057 A 7/1996 Coleman et al.
5,542,581 A 8/1996 Habora et al.
5,543,097 A 8/1996 Fang
5,586,694 A 12/1996 Breidenbach et al.
5,588,562 A 12/1996 Sander et al.
5,590,780 A 1/1997 O'Meara
5,607,860 A 3/1997 Gombrich et al.
5,652,143 A 7/1997 Gombrich et al.
5,653,270 A 8/1997 Burrows
5,655,554 A 8/1997 Goldberg
D385,184 S 10/1997 Binter
D390,117 S 2/1998 Kan et al.
D391,166 S 2/1998 Lang
5,738,067 A 4/1998 Landwehr et al.
5,794,819 A 8/1998 Smith
5,799,838 A 9/1998 Miller
5,803,268 A 9/1998 Levy et al.
5,810,495 A 9/1998 McAuley
5,813,529 A 9/1998 Goserud
5,833,654 A 11/1998 Powers et al.
5,862,490 A 1/1999 Sasuta et al.
5,862,949 A 1/1999 Markey et al.
5,881,742 A 3/1999 Hunsberger
5,884,678 A 3/1999 Chudy
5,897,262 A 4/1999 Brathy-Carey
5,897,265 A 4/1999 Wilson

* cited by examiner

COSMETIC APPLICATOR

FIELD OF THE INVENTION

The present invention relates to an improved cosmetic applicator such as a lipstick dispenser, eye shadow dispenser, concealer containing a skin color covering material, etc. The present invention has particular applicability as a lipstick dispenser that provides the consumer the benefit of reducing the risk of broken or damaged lipsticks as well as providing the consumer with a dispenser that permits the user to remove significantly more of the product than conventional dispensers.

BACKGROUND OF THE INVENTION

For centuries people have been applying decorative materials to their bodies. Evidence shows that the ancient Egyptians applied paints to their bodies especially around their eyes, perhaps to protect them from the sun. Socially, in ancient Egypt, hairstyle and cosmetics distinguished the various social classes from each other. In Greece and Rome particular hairstyles were signs of social standing, age and marital status. After Rome fell the use of cosmetics in Western Europe virtually disappeared until the Crusaders brought perfumes, hair dyes and other beauty products back to Europe. During the Renaissance, a pale look that was achieved by the use of heavy powders was a badge of class and became a longtime status symbol. In France, men and women competed with each other in personal adornment. Various powders, perfumes, wigs, and beauty marks were the rage of the aristocracy. One theory has it that the heavy makeup that was applied was an effort to hide the effects of disease particularly small pox that was endemic to the area. In the Americas, native American tribes, long before the arrival of Columbus, used war paints extracted from fruits, particularly berries, and vegetables. Native Americans used animal fats to coat their bodies and protect them from harsh weather. Over the centuries lip coverings have been used to enhance the color of lips. In addition, many people apply various unguents, balms, salves and moisturizers to their lips to soften them and to enhance them.

Lip products can be applied in a variety of ways and are packaged to assist the application of the product. As a result, there are a variety of dispensers on the market. One common way that lipsticks have been sold is in stick or rod form in a dispenser that has a rotatable base and a screw type mechanism for raising from the dispenser for application by the consumer. In these types of dispensers the lipstick material is held in a cup or base in the shape of a short length of tubing that is sealed at one end. The cup or base is typically up to about 0.5" in height. Since the lipstick material held in these dispensers is only a couple inches high, the cup or base constitutes, in the consumers mind at least, a significant portion of the purchased product. The material in the base is usually thrown away when the portion of the stick above the base has been worn away from use. Many consumers, in an attempt to stretch a few more applications out of the applicator or because they ran out before they were able to purchase a replacement will use their fingertips, a tissue or other means to get at the remainder. This is messy process and not very satisfactory to the consumer.

Another common problem with lip applicators is the issue of breakage of the stick when too great a force is applied, either during application or due to misuse. It is not uncommon for a user of lipsticks to report that from time to time in the haste of application or otherwise, the extended stick of lip material was inadvertently broken off during use. Not surprisingly this breakage usually occurs during the early stages of use by the consumer when the product has hardly been used which creates great dissatisfaction with the product. Similarly, it is not unusual for the raised stick to be damaged inadvertently, or by small children and others who have gotten access to the product. There are many instances where the stick has been smudged, smashed or otherwise ruined due to mishandling.

Some manufacturers of lip products seek to avoid the problems with applicators and the breakage issues of a stick type product by supplying a brush to apply the lip product. Brushes can give a better lip covering than the traditional stick particularly where a professional is applying the product. However, brushes are usually more difficult to use. Because of the flexibility of the brush bristles, it is sometimes difficult to apply the lip covering with a brush. Another problem with brushes is that the application of a lip covering with a brush is a two-handed operation that makes it difficult to apply the lip product in some common situations. When applying the product with a brush, one hand holds the reservoir containing the lip product while the other hand is usually needed to apply it to the lips.

One patent that attempts to solve the problems with stick lip products U.S. Pat. No. 5,772,347 to Gueret. Gueret discloses a dispenser for applying a liquid to pasty consistency material. The patent shows a complex valving arrangement in a container for applying a product. The container is provided with a horizontal disk on a threaded member that causes the disk to rise when the base is turned. The disk forces the product out through a valve and to a plurality of orifices in the tip of the container. The top of the container is oblique to resemble the angle given to many lipsticks that are currently sold. Although this patent solves the breakage problem of stick shaped lipsticks, it does not solve the wastage issue. Where the traditional lipstick has a base, in which the lipstick is placed that causes wastage, the Gueret device'a complex head piece is also a potential source of product waste. The design of the dispensing valve of Gueret is such that significant amounts of material remain in the dispenser when the disk finishes its travel along the threaded rod. In addition, as seen in FIG. 1 of the patent the dispenser's shoulder and neck area have a diameter that is less than the diameter of the disk preventing complete travel of the disk and leaving significant amount of product in the dispenser. It is not uncommon for the consumer who perceives that there is unused product remaining in the dispenser to attempt to open the dispenser. This, at a minimum can be a messy procedure and at its worse can cause injury, particularly if a sharp object is used to open the dispenser.

It is an object of the present invention to provide a dispenser for products that is designed so the possibility of breakage of the product as it extends from the dispenser is eliminated.

It is also an object of the present invention to provide a dispenser for products that is designed so that significant amounts of product do not remain in the dispenser after use of the dispenser is complete.

DETAILED DESCRIPTION OF THE INVENTION

Figure 1:
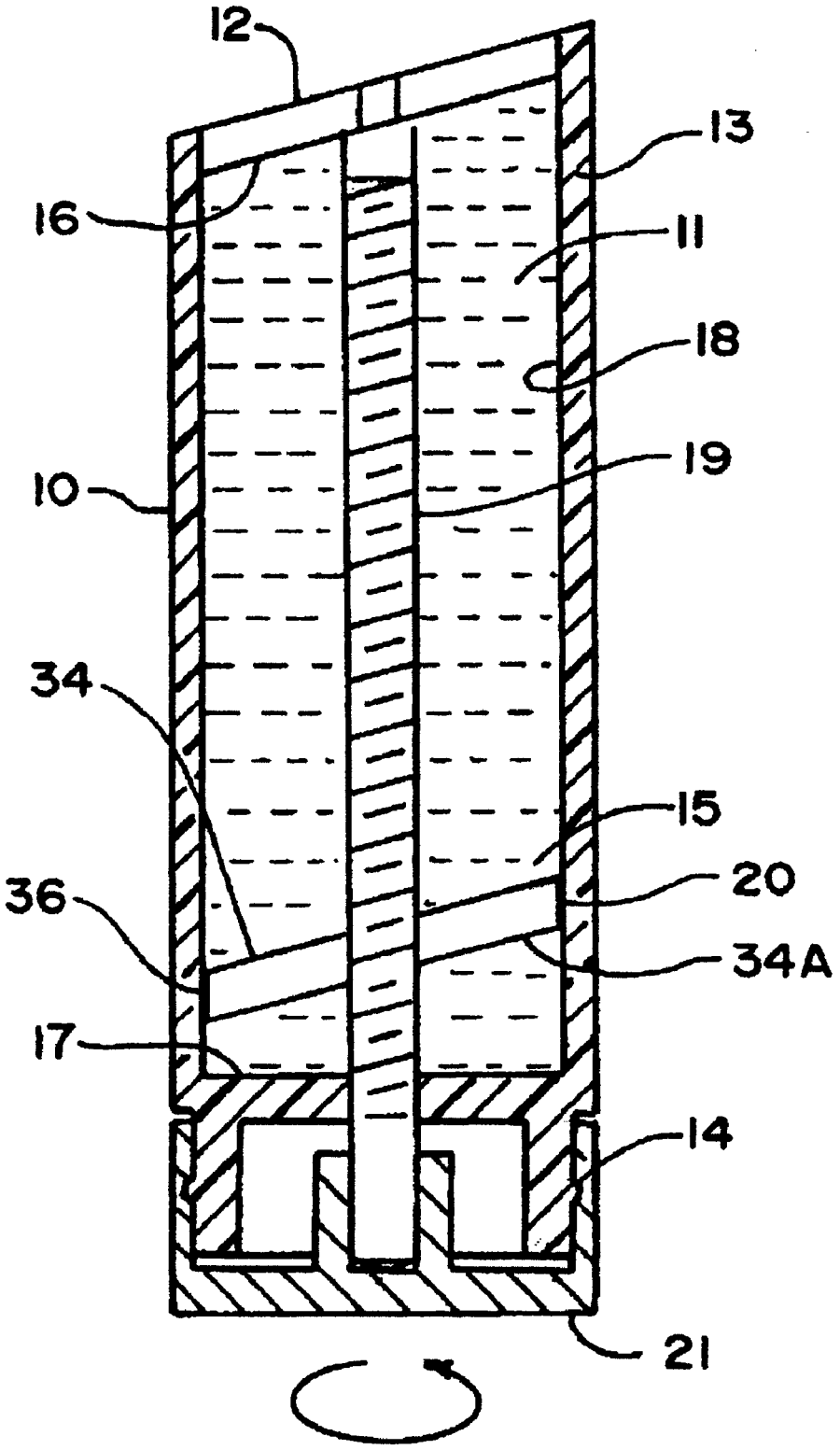
FIG. 1 is a side view of the dispenser of the present invention.
Figure 2:
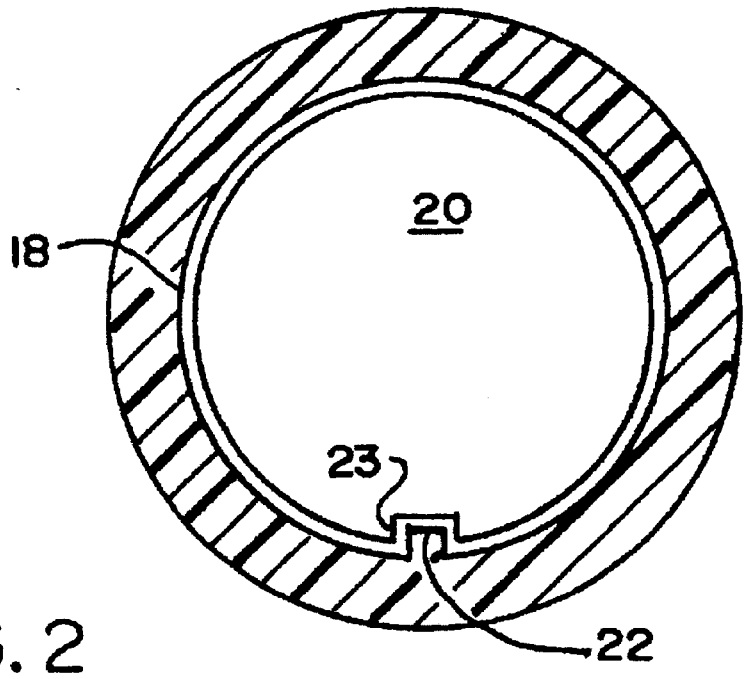
FIG. 2 is a view of the arrangement of the disk and the sidewall of the dispenser in one embodiment of the invention.
Figure 3:
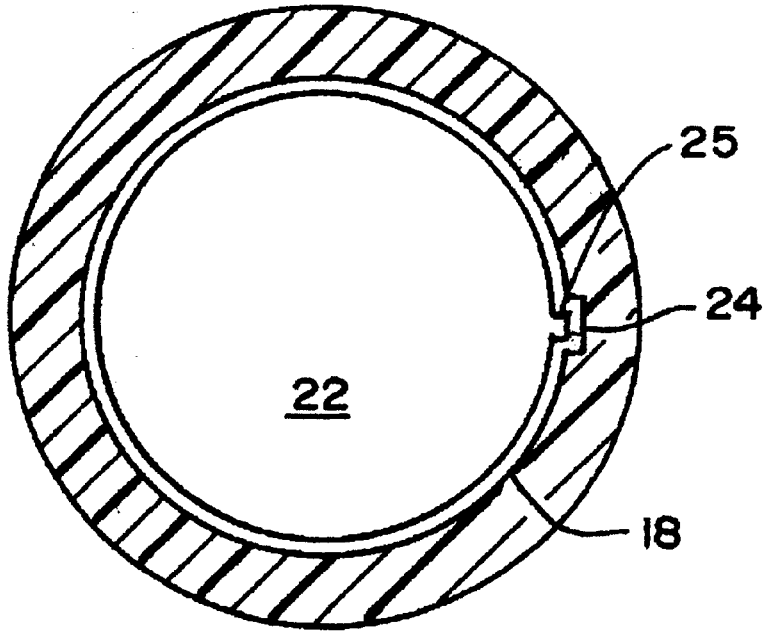
FIG. 3 is a view of the arrangement of the disk and the sidewall of the dispenser in another embodiment of the invention.
Figure 4:
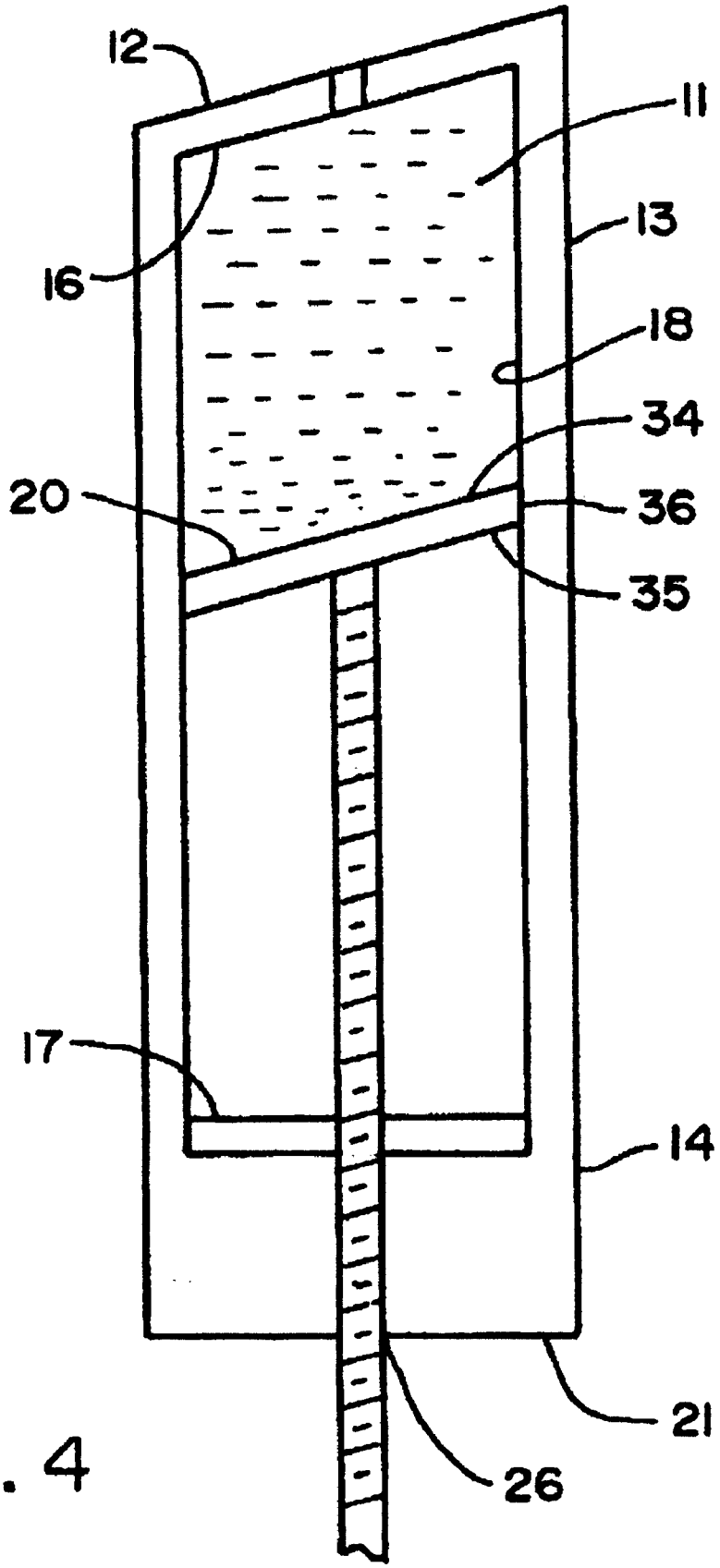
FIG. 4 shows an alternative embodiment of the dispenser of the present invention.
Figure 5:
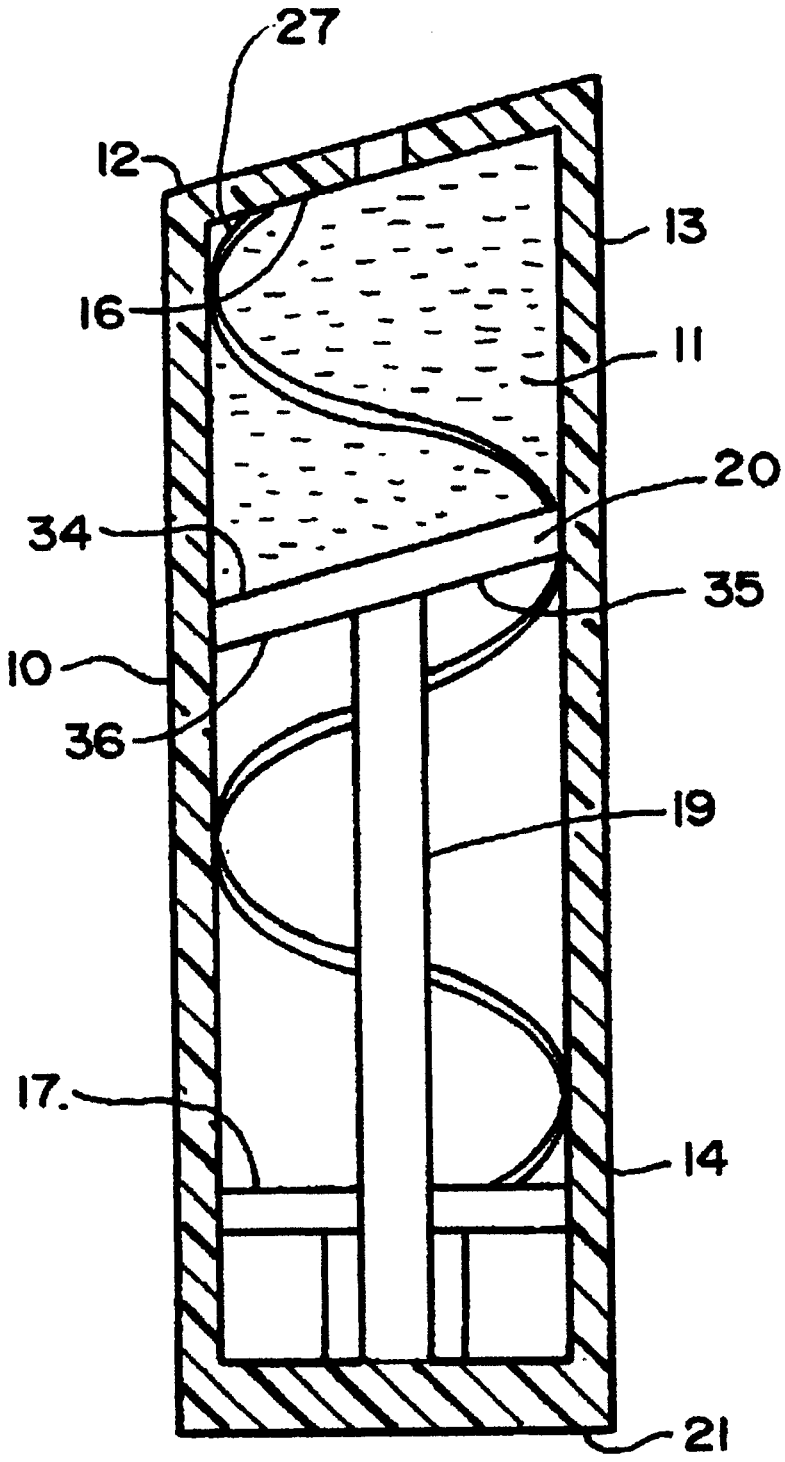
FIG. 5 shows an alternative embodiment of the dispenser of the present invention where there is a helical rail.
Figure 6:
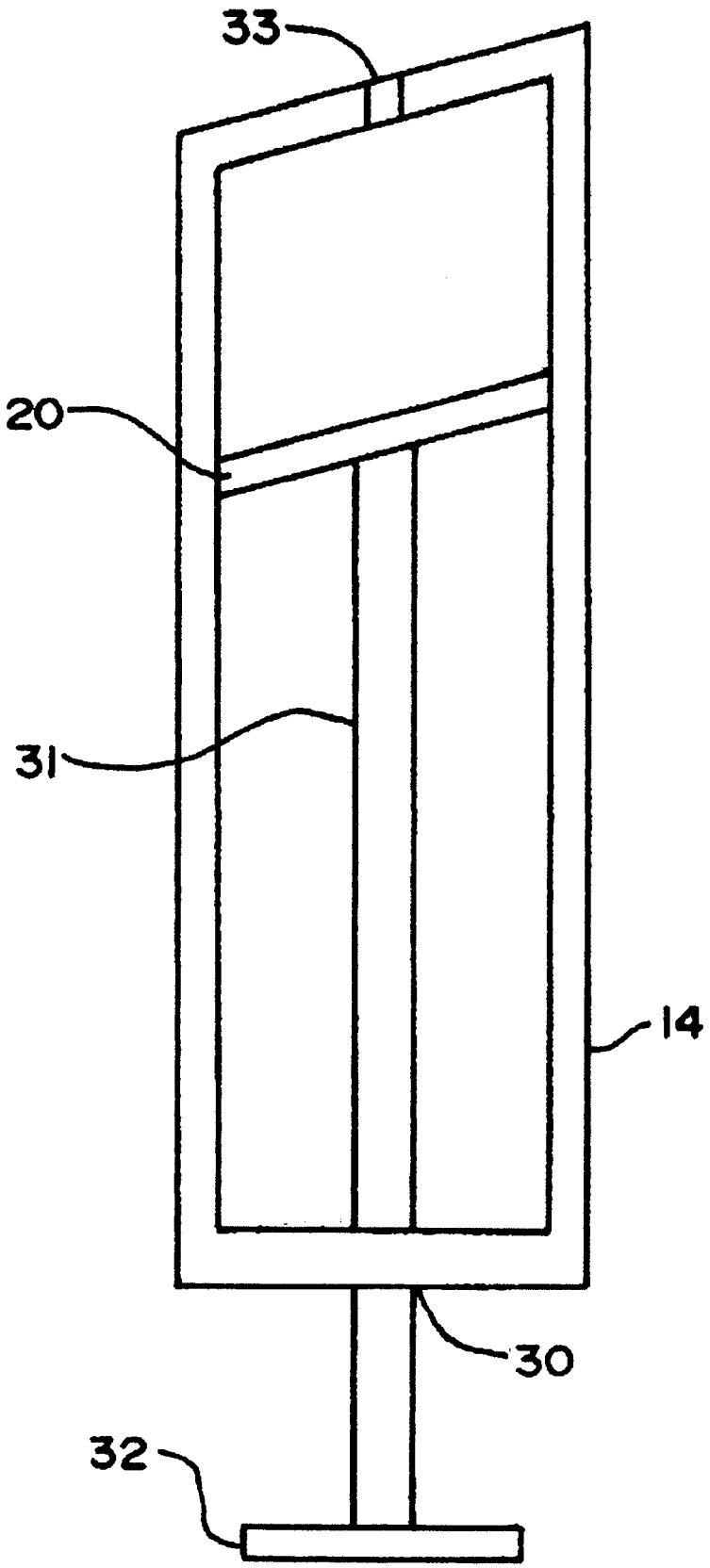
FIG. 6 shows an alternative embodiment of the dispenser of the present invention where there is a push member to apply product.

Referring to FIG. 1 of the drawings there is shown an applicator 10 for a liquid or semi-liquid material 11 to be dispensed. The material may be a lip covering material, a medicament, a glue, paste or any other substance that will flow from an orifice when placed under pressure. The applicator comprises a top surface 12, an exterior sidewall 13, and a base 14. The top surface is preferably angled to provide an application surface for applying the product. The applicator has a chamber 15 which constitutes the reservoir for holding the product to be dispensed. The chamber 15 has a top wall 16 and a bottom wall or floor 17 with side wall 18. The top wall 16 is preferably parallel to top surface 12 of the dispenser. The reservoir may be generally cylindrical in shape, however other shapes are possible. For example, the base and top surface may form a square or rectangle or other geometric shape.

Extending from the base 14 and through the floor 17 is a threaded rod 19. The threaded rod has a disk 20 mounted thereon which is capable of traveling from the floor 17 to the top wall 16. The disk 20 is positioned on the threaded rod so that the angle of the disk in relation to the bottom surface 21 of the base 14 is generally the same as the angle of the top surface 12 to the bottom surface 21 of the base 14. Similarly, the angle of the top wall 16 in relation to the bottom surface 21 of the base 14 is also generally the same as the angle of disk 20 and the top surface 12. The base 14 of the applicator has preferably rotatable and designed to turn the threaded rod to cause the disk 20 to rise through the chamber forcing product forward. In order to prevent misalignment of the disk 20 as it rises through the chamber to meet the top wall 16, the side wall 18 of the chamber 15 may be provided with a rail 22 which mates with a notch 23 in the side of the disk 20. Alternatively, the sidewall 18 of the chamber 15 may be provided with a notch 24 and the disk is provided with a pin 25. Preferably, the rail 22 and notch 24 extend along the sidewall of the chamber for sufficient distance to permit the disk to travel the entire length of the chamber, or as much of the length as is possible. The disk 20 has a product contact surface 34 on its upper surface, a base contact surface 35 on its lower surface and a side 36. While the product contact surface is generally parallel to the top surface 16 of the chamber, the base contact surface 35 can but does not have to be generally parallel to the product contact surface 34.

In an alternate embodiment, the disk 20 does not rise along the threads of threaded rod 19 but is placed on the tip of the threaded rod 19. The base 14 of the applicator is provided with an orifice 26 through which the rod passes. As the threaded rod is turned, the disk rises through the chamber. The interior of the applicator preferably does not have a narrowing or reduction in size of the cross section of the first chamber throughout its length that would prevent the complete travel of the disk from the floor 17 to the top wall 16. A narrowing or reduction in the diameter of the chamber could prevent full travel of the disk and leave the product in a portion of the chamber.

Preferably, when the disk 20 completes its travel and as much of the product as is possible has been eliminated from the chamber, the disk either contacts the top wall or is in close proximity thereto. In a more preferred embodiment the disk contacts a major portion of the top wall. By a major portion is meant that portion of the surface of the top wall so that the amount of product remaining between the top wall and the disk is minimized. This may preferably be accomplished by a top wall and an upper disk surface that have similar configurations. For example, if the top surface is generally flat, the upper disk surface is also flat. Where the top surface is concave, the upper disk surface is convex so the gap between the two is minimized. Where the top surface has some other configuration, the upper surface of the disk is provided with a mating surface that minimizes the gap between the two surfaces and reduces the amount of product remaining in the dispenser when the travel of the disk is complete.

In another embodiment of the invention, the interior or sidewall 18 of the chamber is provided with a generally helical rail 27 which mates with the notch 23. As the base 14 is turned the disk 20 rises in the chamber. The alignment of the rail is such that the disk 20 rotates as the base is turned but at the limit of travel in the vicinity of the top wall 16 the disk is aligned so that it is generally parallel to the top wall 16 and may also be parallel to the top surface 12 thus minimizing the gap between the disk and the top wall. Alternatively, instead of the sidewall 18 being provided with a rail and the disk having a notch, the sidewall 18 of the chamber may be provided with a helical notch 24 that mates with pin 25. In each instance, as the base rotates the disk turns. Typically, when the base 14 is rotated in a first direction, the disk 20 rises as it rotates. When the base rotates in a second direction the disk lowers. To ensure as much of the product as possible has been removed from the applicator, the top surface and top wall 16 are rotatable so that they can be aligned with the disk to remove product if the disk does not in fact line up with the top wall 16.

In another embodiment of the invention, the base 14 of the applicator may have an orifice 30. In this instance the base does not have to be rotatable. A rod 31 passes through the orifice 30. At the end of the rod that is in the chamber, the disk 20 is connected. The remaining end of the rod may be a push surface 32. In order to dispense product in this embodiment, pressure is placed on the push surface 32 causing the disk to rise in the chamber forcing product from the orifice.

The top surface 12 of the dispenser may be the applicator surface itself, if desired. If that is the case, the top surface 12 is provided with an orifice 33 that extends from the top surface 12 to the top wall 16. In the preferred embodiment the distance from the top surface 12 to the top wall 16 is as short as possible to reduce the amount of product that may be lodged in the orifice when the disk completes its travel as the applicator is emptied.

Figure 7:
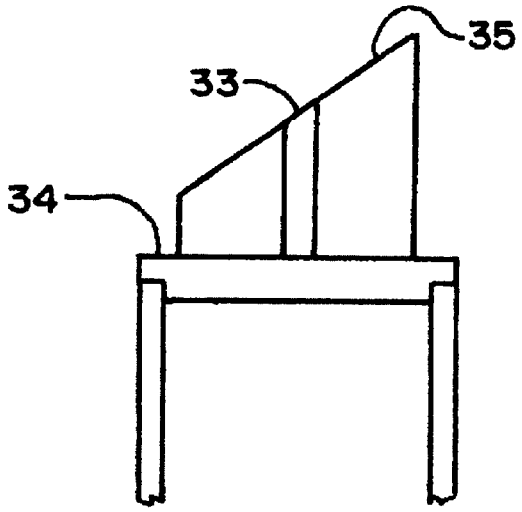
FIG. 7 shows an example of a headpiece for the applicator of the present invention.

In one embodiment as shown in FIG. 7 the top surface 12 is not the applicator surface and the orifice is designed to accommodate a head piece 34. Preferably, this headpiece is removable to permit the applicator to be opened and provide access to the chamber to facilitate filling of the applicator with product. In the preferred embodiment the applicator insert is shaped at its distal end 35 to resemble a stick of lipstick and has an angled applicator surface. The head piece 34 is preferably comprised of a flexible plastic material such as an elastomeric material. These may include elastomers of polyethylene, polyurethane or polyester. They may also include such materials as polyester block amides, polyvinyls, terpolymers of ethylene, of propylene and a diene also known as EPDM. And other such materials known to those skilled in the art.

Figure 8:
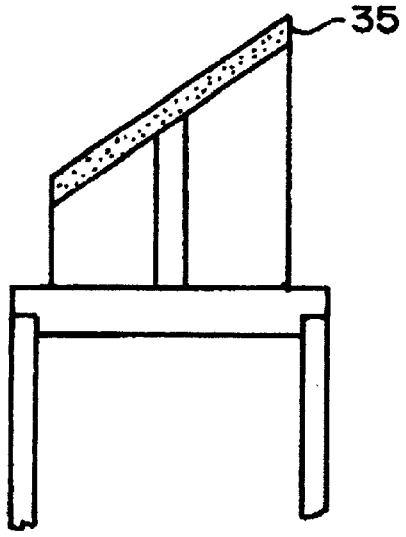
FIG. 8 shows an alternative embodiment of the applicator of the present invention wherein the applicator surface is a sponge or foamed material and the tip is angled.
Figure 9:
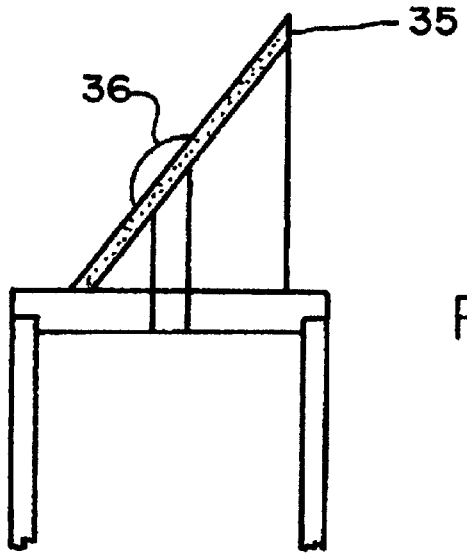
FIG. 9 shows an alternative embodiment of the applicator of the present invention wherein the applicator surface is a sponge or foamed material and the tip has a point.

In an embodiment shown in FIG. 8 the dispenser of the present invention may also include a soft or hard porous material such as a sponge or foamed material 40 on the applicator surface 12. The orifice 33 passes material from the chamber to the porous material on the applicator surface. When the cosmetic material 41 in the chamber passes through the orifice there is a tendency for it to bail up on the porous surface where the porous surface can be used to blend and smooth the cosmetic. See FIG. 9. The dispenser of the present invention with the porous surface is particularly suitable for packaging eye shadow, a concealer or other skin colored, liquid or semi-liquid, covering material where the porous material permits the user to blend the cosmetic that has been applied. The porous material may be angled as shown in FIG. 8, and/or have a pointy tip to facilitate application as shown in FIG. 9. The porous material can be on a headpiece as seen in FIGS. 8 and 9 or on the dispenser applicator surface 12 when no headpiece is present.

Figure 10:
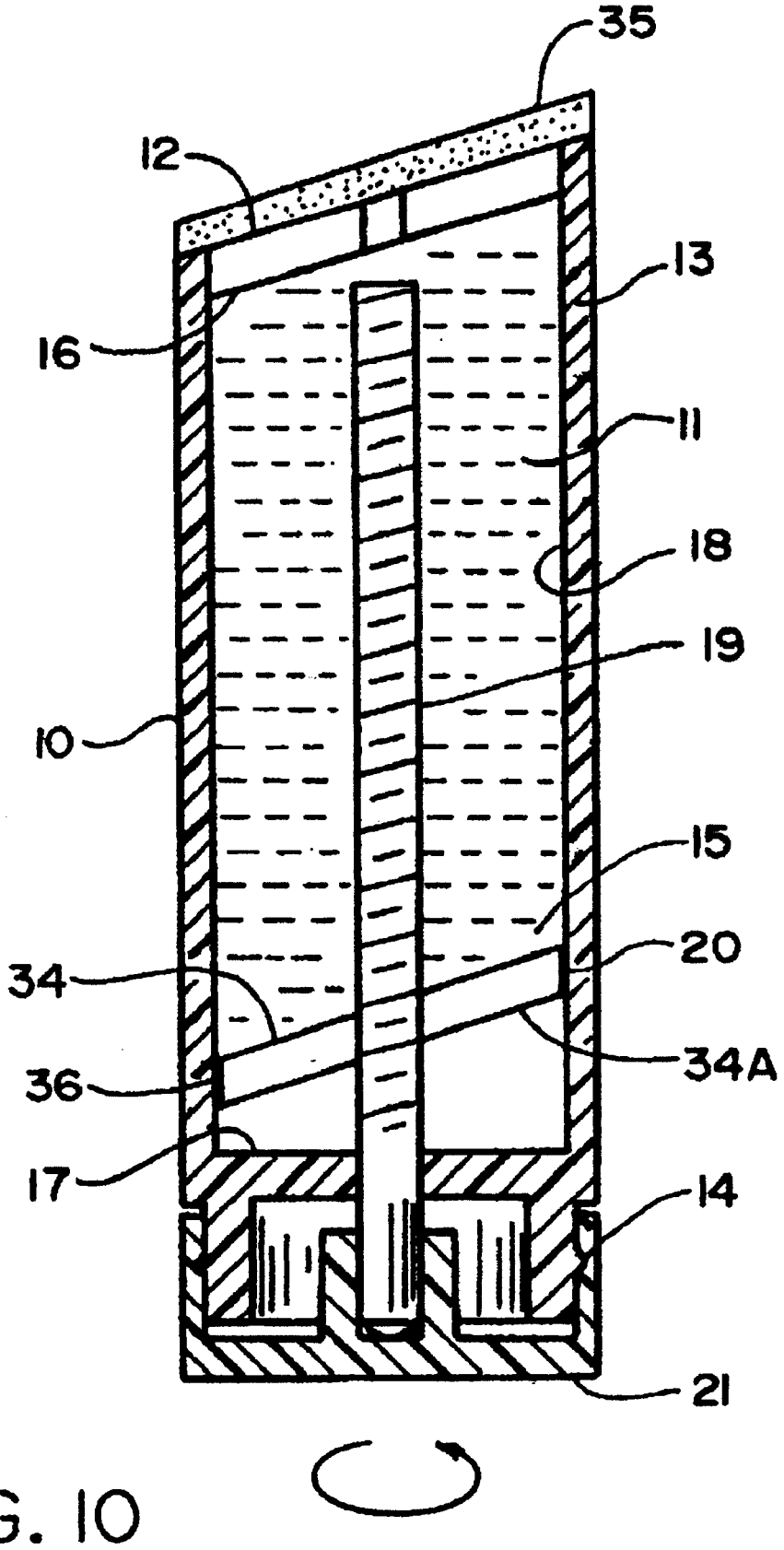
FIG. 10 shows the applicator of FIG. 1 with a foamed material on the applicator surface.
Figure 11:
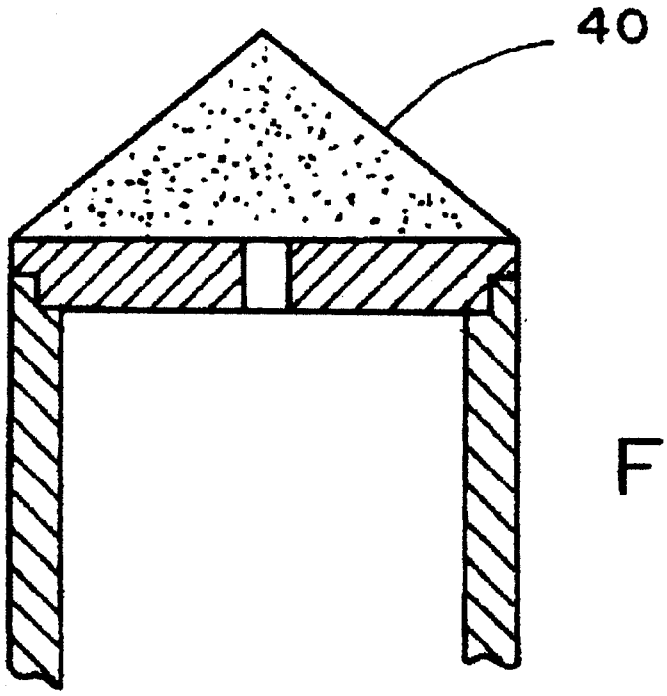
FIG. 11 shows an applicator of the present invention with a pointed porous material as the applicator surface.

As seen in FIG. 10, the applicator of FIG. 1 may be provided with a porous material such as a sponge or foamed material on the applicator surface. Alternatively, the top surface may have a pointed porous surface as seen in FIG. 11. FIG. 11 shows a separate headpiece but the top surface may be integral with the body as shown in FIG. 1.

Figure 12:
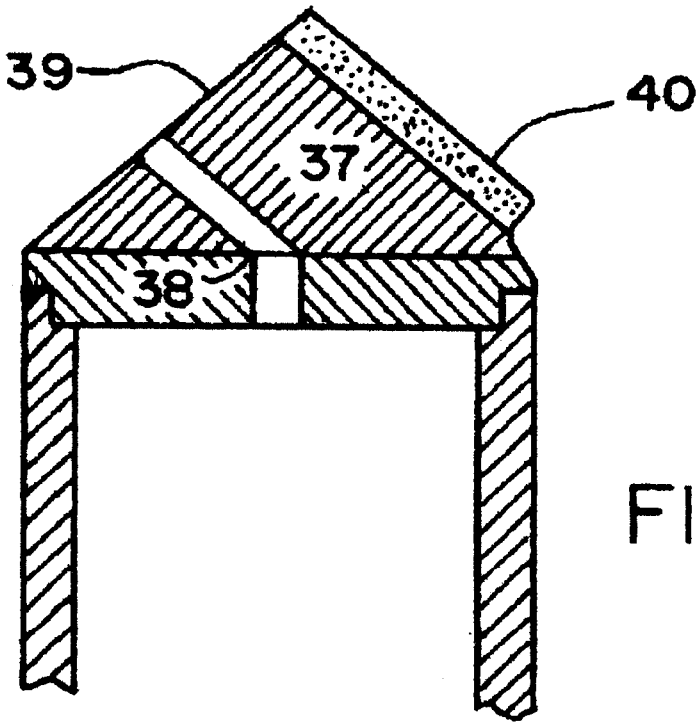
FIG. 12 shows an applicator of the present invention where the applicator surface is generally pointed or triangular or conical in shape with a porous material on a portion of a surface.
Figure 13:
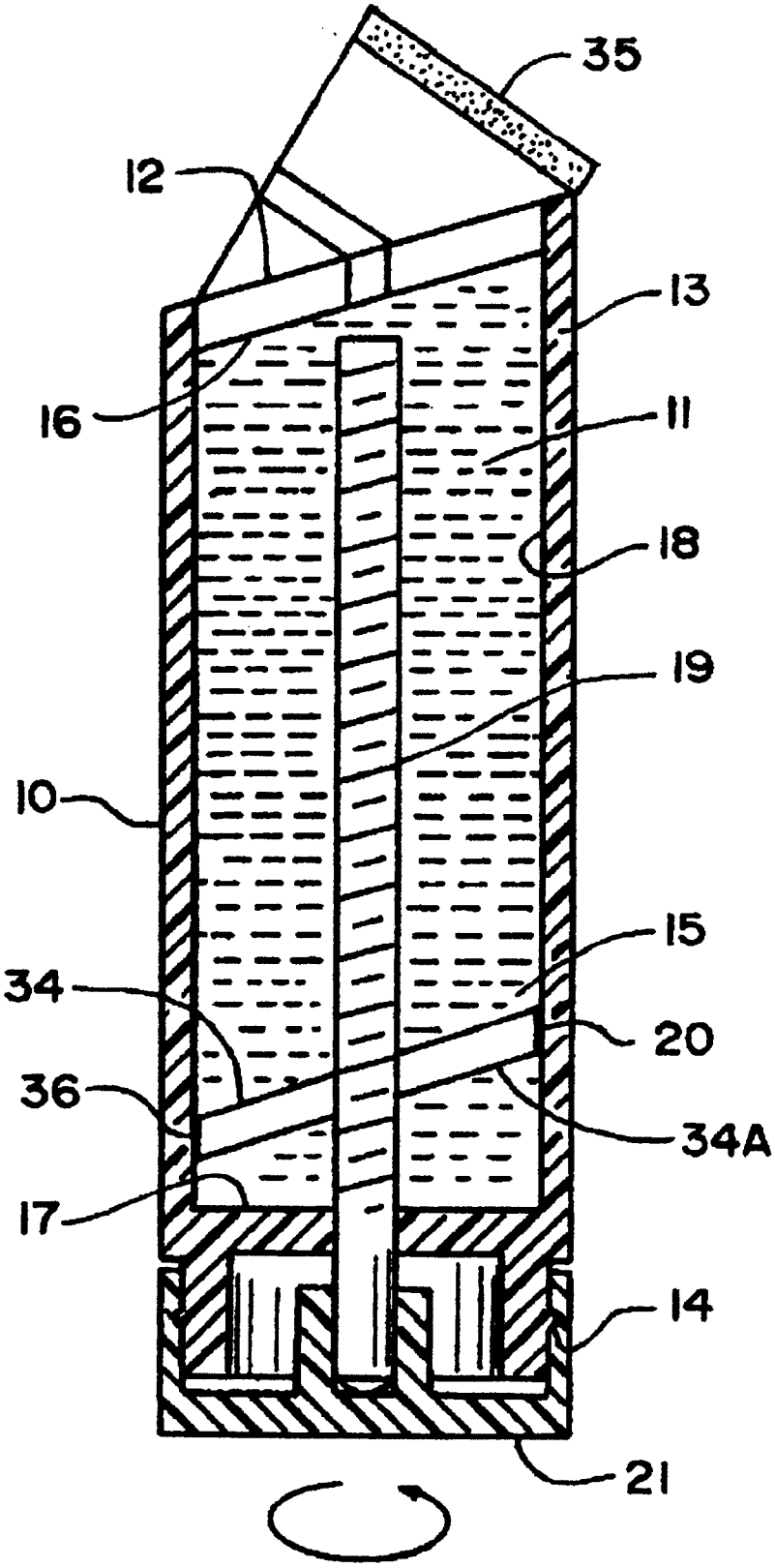
FIG. 13 shows the applicator of FIG. 1 with the applicator surface of FIG. 12.

FIG. 12 shows an applicator of the present invention where the applicator surface is generally pointed or triangular or conical in shape with a porous material on a portion of a surface. Where the applicator surface is for example generally triangular, the base of the triangle 37 has an orifice 38 for material to pass through to applicator surface 39. On the other side of the triangle the porous material 40 provides a blending surface to blend the cosmetic material that is on the applicator surface after the material is applied to the user. FIG. 13 shows the applicator of FIG. 1 with the applicator surface shown in FIG. 12.

We claim:

1. An applicator for dispensing a product that flows under pressure comprising an exterior top surface, an exterior sidewall, and a base, said applicator having a chamber which constitutes a reservoir for holding the product to be dispensed, said reservoir having a top wall, a bottom wall and a side wall, said applicator having an orifice for dispensing the product, said orifice connecting said top surface to said top wall, said chamber having therein a disk capable of traveling through the chamber forcing the product through said orifice as it travels through said chamber, said disk having a generally flat product contact surface that contacts a major portion of said top surface when the travel of the disk is complete so that the product remaining in said chamber is minimized and wherein said exterior top surface is angled with respect to the base such that a first portion of the exterior sidewall extends further from the base than a second portion of said exterior sidewall opposite said first portion of said exterior sidewall, the angle of said exterior top surface in relation to the base is generally the same as the angle of the product contact surface of the disk to the base.

2. The applicator according to claim 1 wherein the top surface is provided with a head piece that has an angled applicator surface at its distal end.

3. The applicator according to claim 2 wherein the headpiece is removable.

4. The applicator according to claim 1 wherein said exterior top surface and said top wall are generally parallel to each other.

5. An applicator for dispensing a product that flows under pressure comprising an exterior top surface, an exterior sidewall, and a base, said applicator having a chamber which constitutes a reservoir for holding the product to be dispensed, said reservoir having a top wall, a bottom wall and a side wall, said applicator having an orifice for dispensing the product, said orifice connecting said top surface to said top wall, said chamber having therein a disk having a generally flat product contact surface capable of traveling through the chamber forcing the product through said orifice as it travels through said chamber, said chamber being configured such that said top surface is generally parallel to said bottom wall and a sidewall that is generally perpendicular to said bottom wall and said top surface, the angle of said exterior top surface in relation to the base is generally the same as the angle of the product contact surface of the disk to the base.

6. The applicator according to claim 5 wherein the product contact surface of said disk mates with said top wall.

7. The applicator according to claim 5 wherein the top surface is provided with a head piece that has an angled applicator surface at its distal end.

8. The applicator according to claim 7 wherein the headpiece is removable.

* * * * *